United States Patent [19]

Dörflinger

[11] Patent Number: 4,610,290

[45] Date of Patent: Sep. 9, 1986

[54] PULL-UP CURTAIN WITH PULL-UP DEVICE

[76] Inventor: Peter Dörflinger, Leutkircher Str. 31, Isny/Allgäu, Fed. Rep. of Germany, 7972

[21] Appl. No.: 580,227

[22] Filed: Feb. 15, 1984

[30] Foreign Application Priority Data

Jan. 30, 1984 [DE] Fed. Rep. of Germany ..... 3305300

[51] Int. Cl.[4] ..... A47H 5/032

[52] U.S. Cl. ..... 160/84 R

[58] Field of Search ..... 160/84 R, 319, 171, 160/170, 310; 24/336

[56] References Cited

U.S. PATENT DOCUMENTS

| | | | |
|---|---|---|---|
| 1,084,781 | 1/1914 | Behrle | 160/84 R |
| 2,738,005 | 3/1956 | Nisenson | 160/170 |
| 3,371,700 | 3/1968 | Romano | 160/84 R |
| 3,603,372 | 9/1971 | Dietzsch | 160/170 X |
| 3,668,744 | 6/1972 | Moody et al. | 248/68.1 X |
| 3,817,309 | 6/1974 | Takazawa | 160/84 R |
| 4,414,716 | 11/1983 | Stastney | 24/336 X |

FOREIGN PATENT DOCUMENTS

| | | | |
|---|---|---|---|
| 248439 | 1/1963 | Australia | 160/171 |
| 1964335 | 9/1970 | Fed. Rep. of Germany | 160/171 |
| 2324561 | 4/1977 | France | 160/310 |
| 2410117 | 7/1979 | France | 160/84 R |

*Primary Examiner*—Ramon S. Britts
*Assistant Examiner*—David M. Purol
*Attorney, Agent, or Firm*—Lilling & Greenspan

[57] ABSTRACT

The pull-up device of a pull-up curtain consists of a winding shaft, disposed parallel to the longitudinal axis of the curtain rod, driven in rotary motion and rotatably mounted in bearing blocks mounted on the curtain rod, several mutually spaced winding spools being fixed to the winding shaft. A vertical pull-up band each can be wound on every winding spool, said pull-up band being led through mutually vertically spaced band guidance elements of a loop band which is fastened to the curtain in vertical alignment with the winding spool, the lower end of the pull-up element being fastened to the lower part of the curtain. The pull-up band is of rectangular section, and the winding spool is axially movable on the winding shaft, the flanges of the winding spool being only slightly further apart than corresponds to the width of the pull-up band.

3 Claims, 6 Drawing Figures

PULL-UP CURTAIN WITH PULL-UP DEVICE

BACKGROUND OF THE INVENTION

The invention relates to a pull-up curtain.

Such a pull-up curtain has become known, for example, from the subject of DE-GM No. 82 00 021. Therein, a winding shaft is rotatable mounted to a profiled aluminum bar, fastened by brackets to the wall or ceiling, by means of plastic bearing blocks suspended from the profile of the aluminum bar.

Rotating with the winding shaft are several winding spools of relatively wide design. A drive pulley, over which a smooth cord runs, is rigidly mounted to one end of the winding shaft. The cord is tied to form a endless loop and engages in clamping fashion between the flanges of the drive pulley so that the latter is rotated when the cord is pulled, thus driving the winding shaft, including the winding spools mounted on it in rotary motion.

Vertically below the respective winding spools vertical loop bands are sewn to the curtain, extending over the entire vertical length of the curtain. Depending on the desired spacing of the curtain folds, loops are fastened to the loop band in predetermined and uniform intervals. A vertical pull element, in the form of a cord in this known arrangement, is led through the loops. One end of the pull element is fastened between the flanges of the winding spool, such a pull element being assigned to each winding spool. Due to the fact that the spacing between the winding spool flanges is considerably greater than the cord width, there is the serious disadvantage that as the winding spools wind up the cord, they are wound on them in a relatively disorderly manner. The cord turns criss cross the spool on top of one another so that one of several juxtaposed winding spools will shorten the cord assigned to it more than the other adjacent one. One side of the curtain is then pulled up higher by the pulling operation than the other side so that in its pulled-up state, the curtain does not hang straight, rather it droops or throws folds.

Another disadvantage was that the cordlike pulling element experienced a relatively large amount of friction in the area of the loops of the loop band so that it was relatively hard to pull the curtain, and the way it folded was unsatisfactory.

Another disadvantage was that the cordlike pulling element experienced a relatively large amount of friction in the area of the loops of the loop band so that it was relatively hard to pull the curtain and the way it folded was unsatisfactory.

Another disadvantage was that if the loop band with the associated loops was sewn to the curtain crookedly, the respective cordlike pulling element also wound crookedly on the winding spool during the pulling operation, causing the windings on the winding spool to be heaped on top of each other in a particularly disadvantageous manner so that, after pulling, the entire curtain would hang obliquely in an optically unsightly manner.

SUMMARY OF THE INVENTION

Starting from a subject of the kind described at the outset, it is an object of the present invention to further develop such a pull-up curtain so that it can be handled much more easily and safely.

One essential feature is that, due to the use of pulling elements of rectangular section and winding spools on which the pulling elements are wound in orderly fashion, a better gathering of the curtain is now possible. Now it can no longer happen that the windings crisscross each other so that the pulling element of one winding spool is shortened more than that of the adjacent spool.

Even if the loop band, through the loops of which the pulling element is led, is inadvertently sewed on crookedly, axial movement of the winding spools on the winding shaft achieves that the winding spools yield to a lateral axial pull, causing them to move on the winding shaft, whereby an oblique alignment of the pulling elements is evened out.

According to a further development of the idea behind the invention it is provided, that the pulling element is led through solid, non-twisting loops of the loop band. This facilitates gathering of the curtain considerably because the severe friction occurring before on the twisting, cordlike loops of the loop band is now avoided by providing solid, non-twisting loops.

In a preferred embodiment, it is provided that the loops, as band guidance elements, be made of a pliant plastic material and the pull-up band be guided so as to be easily movable in a recess of approximately rectangular section. This assures the desired low-friction travel of the pull-up band through the band guidance element. It is also essential that the band guidance elements are now exchangeable on the loop band and can readily be repositioned so that the user can adjust the desired spacing of the curtain folds himself at the installation site. Towards this end a slot is provided in the band guidance element, the one slot boundary being formed by a spring leg whose barblike end elastically closes an opening to the slot. This makes it possible to fasten the band guidance element detachably to the loops of a conventional curtain tape.

In the arrangement of the state of the art a loop band with fixed loops was provided which prohibited varying the loop spacings. The invention, instead of a loop band which is relatively costly to produce, utilizes a conventional curtain tape as sewn in horizontal direction to conventional curtains, appropriate curtain roll rings running in appropriate curtain rod grooves being pulled through the loops.

All data and characteristics disclosed in the documents, in particular the physical design shown in the drawings, are claimed as essential to the invention to the extent that, singly or in combination, they are novel with regard to the state of the art.

BRIEF DESCRIPTION OF THE DRAWINGS

The invention is explained below in greater detail by way of drawings showing only one embodiment example. The drawings and their description reveal additional essential features and advantages of the invention.

Figure 1:
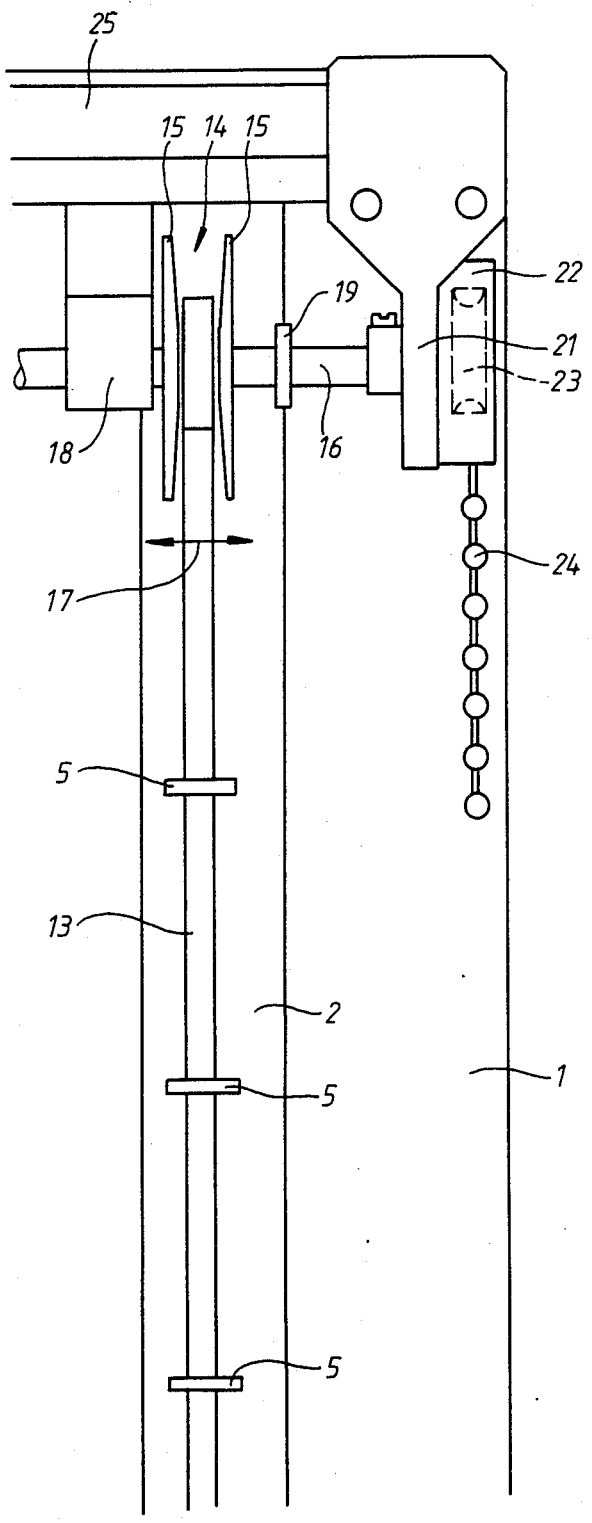
FIG. 1 is a rear view of the right-hand side of a pull-up curtain.

At its top, a pull-up curtain 1 is attached to a profiled bar 25 in a manner not detailed. The profiled bar 25 is connected to a plastic bracket 26 which fasten it to a wall or ceiling. The lower profile of the profiled bar 25 is engaged by bearing blocks 18, 21, between which a winding shaft 16 is rotatably mounted. The winding shaft 16 projects unilaterally out of the bearing block 21, where it is rigidly joined to a drive pulley 23 integrated in the housing of a pull-up device 22. The drive pulley 23 serves the form-locking engagement of a ball chain 24 designed, in a manner not shown, as an endless loop. By pulling the ball chain 24 the drive pulley 23 is turned without slippage, taking along the winding shaft 16.

Figure 2:
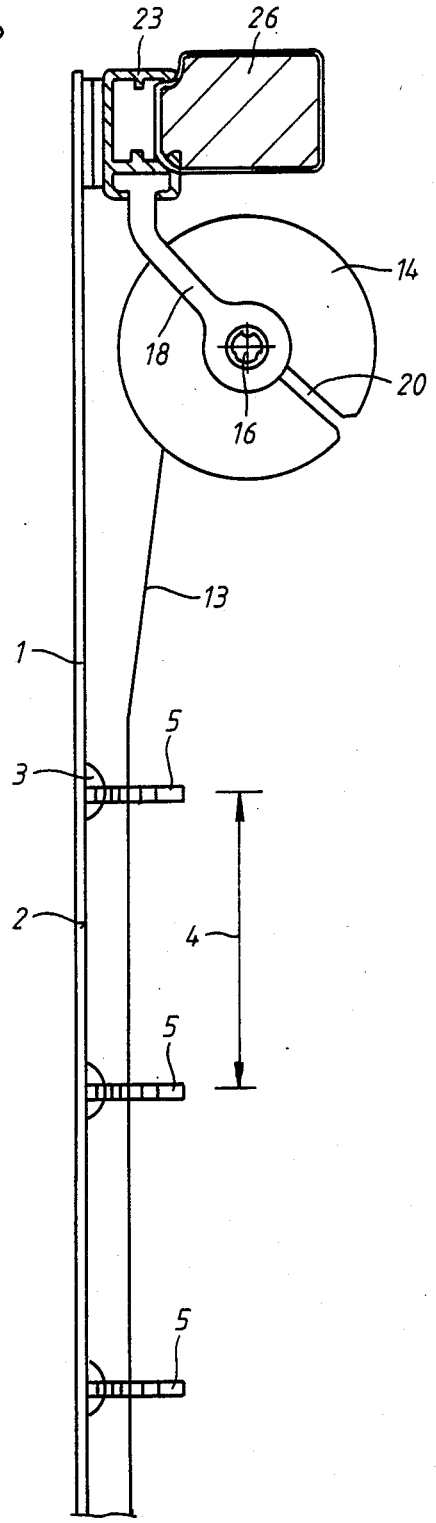
FIG. 2 is a side view of a pull-up curtain.

Several juxtaposed winding spools 14, of which only one is shown in FIGS. 1 and 2, are fixed and spaced on the winding shaft 16. Each winding spool 14 consists of two mutually spaced flanges 15, the winding spool 14 being axially movable on the winding shaft 16 in the arrow directions 17. Its axial motion is limited on the left by the bearing block 18 and on the right by a collar 19 which is clamped, but can be axially shifted, on the winding shaft 16.

Fastened vertically to the pull-up curtain 1 is a loop band 2, designed as conventional curtain tape. This results in the advantage that the loops 3 are arranged relatively close to each other and that the user can choose different loop spacings. In other words, the user can select the distances 4 between the loops 3 by selecting different loops of the loop band 2, looping into them the band guidance elements 5 shown in FIGS. 1–3 to change the spacing of the curtain folds.

Figure 3:
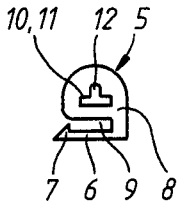
FIG. 3 is a top plan view of a band guidance element.

The band guidance element 5 shown in FIG. 3 consists of a lower spring leg 6 provided with a barbed head 7 in front, a slot 9 being provided in the direction towards the body of the band guidance element 5. To connect the band guidance element 5 to the loop band 2, the head 7 is moved towards the loop 3, the leg 6 deflecting elastically down and the barb on head 7 briefly opening the slot 9 towards the face so that the loop 3 snaps into the slot 9 where it is secured in its position. The band guidance element 5 is thus connected immovably, but detachably to the loop 3 of the loop band 2, and the band guidance element 5 is thus untwistably joined to the loop, thereby preventing canting and tangling with the pull-up band 13 strung through the recess 10.

Disposed in the body 8 of the band guidance element 5 is another recess 10 consisting of an oblong slot 11 with a recess 12 starting approximately in its center. The pull-up band 13 is strung through this slot 11. A further development of the invention provides for this slot 11, like the arrangement of slot 9, to have an open side to facilitate the introduction of the pull-up band 13 into the slot 11. The width of slot 11 is slightly greater than the width of the pull-up band 13 to make it run easily through the slot 11 to achieve the above described easy operation of the pull-up device.

The recess 12 serves the purpose of anchoring the pull-up band 13 to the lower part of the pull-up curtain 1. There the pull-up band 13 is joined to the lowest band guidance element 5 by making a knot in the pull-up band 13 and introducing the knot into the recess 10 so that it rests and is clamped in the upper recess 12.

This assures a simple fastening of the pull-up band 13 which can be unfastened again at any time by pulling the knot out of the slot 11.

The pull-up band 13 is here accommodated between the flanges 15 of the winding spool 14, the flanges 15 being only slightly further apart than corresponds to the width of the pull-up band 13. This results in the advantage that when several winding spools 14 are juxtaposed, the shortening of the pull-up band 13 occurs in exact synchrony when the curtain is pulled up, thus preventing the formation of oblique folds and canting or crooked raising.

Another feature is that the winding spool 14 is mounted on the winding shaft 16 so as to be movable axially in the arrow directions 17 so that, even if the loop band 2 was sewn on obliquely causing the pull-up band 13 to wind obliquely onto the winding spools 14, the respective winding spool 14 will move axially in the arrow directions 17, thus assuring that the pull-up band 13 is always wound up straight.

The winding spool 14 rotates with the winding shaft 16 because, the latter is of a triangular section with grooves engaged by appropriate projections of the winding spool 14 as shown in FIG. 2.

Another essential feature is that only a single bearing block 18 is associated with each winding spool 14 while a collar 19, adjustable in arrow direction 17, is clamped on the winding shaft 16 on the opposite side. This means a substantial saving of material because only one bearing block is used and the collar 19 can be produced very cheaply.

Figure 4:
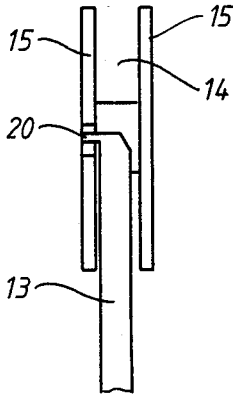
FIG. 4 is a side view of a winding spool with a pull-up band fastened to it.
Figure 6:
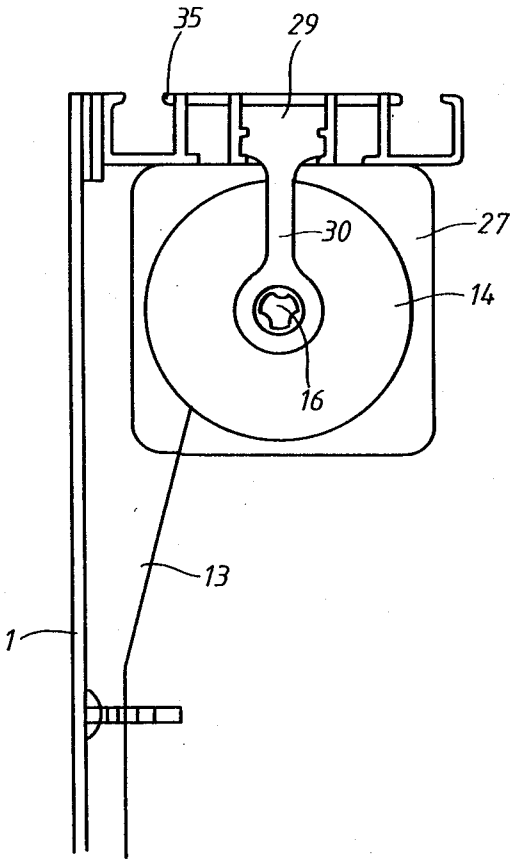
FIG. 6 is a side view of FIG. 5.

As illustrated in FIG. 4, the pull-up band 13 is fastened to the winding spool 14 in that a radial slot 20 is cut into at least one flange 15 of the winding spool 14. A knot is tied into the pull-up band 13, the knot resting against the outside of flange 15. As shown in FIG. 2, the slot 20 goes to the base of the winding spool 14 so that the knot rests against the flange 15 in clamping fashion. Another embodiment shown in FIGS. 5 and 6 illustrates how a drive motor 27 is integrated within the pull-up device.

In the arrangements disclosed in the art, it was only known heretofore to mount such a drive motor 27 outside of the pull-up device, such as the area of the ball chain 24. The drive motor 27 was then fastened separately to the wall and had to be connected via separate transmission elements to the drive pulley 23 of the pull-up device 22.

Figure 5:
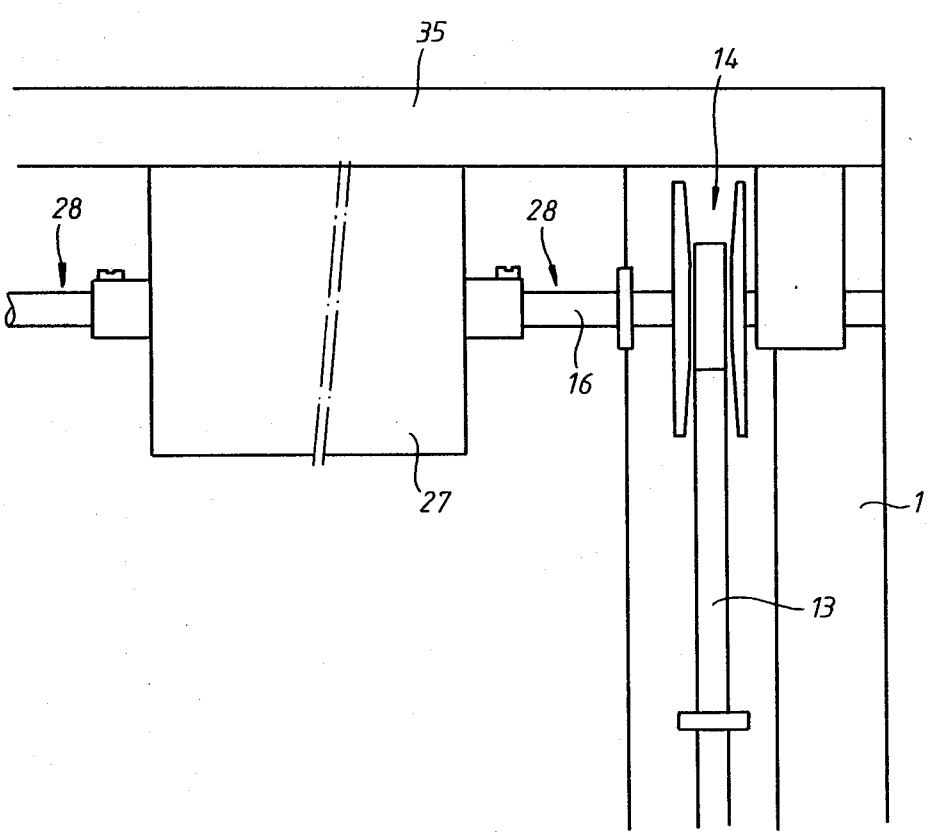
FIG. 5 is a rear view of a right-hand side of a pull-up curtain with an integrated drive motor.

In the embodiment illustrated in FIG. 5, the drive motor 27 is integrated directly in the winding shaft 16. This results in the advantage that the drive motor 27 is fastened directly to a profiled rod 35, hidden behind the pull-up curtain and is mounted in bearing blocks 30 which engage appropriate profiled grooves 29 of the profiled rod 35. This makes it possible to shift the drive motor 27 by shifting the bearing blocks 30 in the area of the profiled grooves 29 to meet the requirements of the installation.

The power transmission is also much better because the drive motor 27 can transmit its power directly to the winding shaft 16, obviating otherwise required, interposed transmission elements.

In a manner not detailed, the drive motor 27 can be framed in the locations 28 by bearing blocks not detailed in which the winding shaft 16 is rotatably mounted in ball or friction bearings.

By shifting the bearing blocks 18, 21, 30 in the area of the grooves in the profiled rod 25, 35 it is possible to juxtapose any number of winding spools mutually spaced on the winding shaft in a modular system.

I claim:

1. A self-adjusting pull-up curtain device comprising:

(a) a curtain rod connected to an upper horizontal part of a curtain;

(b) a pull-up device having a winding shaft disposed parallel to a longitudinal axis of said curtain rod, said pull-up device rotatably mounted in bearing blocks secured on said curtain rod, and said pull-up device being rotatably driven by a driving means;

(c) axially moveable winding spools mutually spaced and rotatably fixed on said winding shaft;

(d) a pulling element winding around each of said winding spools by leading pulling element through vertically spaced loops of a loop band fastened to the curtain in vertical alignment with said winding spools;

(e) a pull-up band attached to a lower end of said pulling element and fastened to a lower part curtain, said pull-up band being designed as a rectangular section to be wound on each of said winding spools;

(f) solid non-twisting band guidance elements connected to said loop band and through which said pull-up band is led;

(g) flanges of said winding spool laterally disposed, a distance slightly greater than a width of said pull-up band; and (h) a collar being adjustably clamped to said winding shaft and being paired to one of said bearing blocks in which said winding shaft is rotatably mounted, said winding spools disposed on said winding shaft between said collar and said bearing block, whereby said collar limits the axial movement on one side of said winding spool and said bearing block limits axial movement on a second side of said winding spool.

2. A self-adjusting pull-up curtain according to claim 1, wherein said band guidance elements being made of a pliant plastic material further comprises a recess having a rectangular section through which said pull-up band is led, said band guidance elements having a spring leg forming one boundary of a slot and having a barblike head elastically closing an opening of said slot, said spring leg being inserted under a loop of a conventional curtain tape and vertically fastened to said loop band of said curtain in alignment with each of said winding spool.

3. A self-adjusting pull-up curtain according to claim 1, wherein said driving means comprises a drive motor having a driving shaft rigidly joined to said winding shaft in an area between said bearing blocks.

* * * * *